US009020391B2

(12) United States Patent
Hashimoto

(10) Patent No.: US 9,020,391 B2
(45) Date of Patent: Apr. 28, 2015

(54) IMAGE FORMING APPARATUS CAPABLE OF EASILY DRAWING IMAGE FORMING UNIT FROM MAIN CASING

(71) Applicant: Junichi Hashimoto, Toyohashi (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/936,333

(22) Filed: Jul. 8, 2013

(65) Prior Publication Data

US 2014/0016963 A1 Jan. 16, 2014

(30) Foreign Application Priority Data

Jul. 10, 2012 (JP) ..... 2012-154317

(51) Int. Cl.
*G03G 21/16* (2006.01)
*G03G 21/18* (2006.01)

(52) U.S. Cl.
CPC ..... *G03G 21/1814* (2013.01); *G03G 21/1633* (2013.01); *G03G 2215/0141* (2013.01); *G03G 2221/1684* (2013.01)

(58) Field of Classification Search
CPC ..... G03G 21/18
USPC ..... 399/110, 128
See application file for complete search history.

(56) References Cited

U.S. PATENT DOCUMENTS

| | | | | |
|---|---|---|---|---|
| 7,715,753 | B2 | 5/2010 | Hisada | |
| 7,890,019 | B2 | 2/2011 | Tateishi et al. | |
| 7,894,747 | B2 | 2/2011 | Hisada | |
| 8,059,989 | B2 | 11/2011 | Tateishi et al. | |
| 2006/0140669 | A1* | 6/2006 | Sato | 399/110 |
| 2006/0222402 | A1* | 10/2006 | Sato et al. | 399/111 |
| 2008/0304860 | A1 | 12/2008 | Hisada | |
| 2010/0119254 | A1 | 5/2010 | Tateishi et al. | |
| 2010/0183352 | A1 | 7/2010 | Hisada | |
| 2010/0247143 | A1 | 9/2010 | Tateishi et al. | |
| 2012/0183325 | A1* | 7/2012 | Sato et al. | 399/110 |
| 2013/0259521 | A1* | 10/2013 | Sugiyama | 399/110 |
| 2014/0016963 | A1* | 1/2014 | Hashimoto | 399/110 |

FOREIGN PATENT DOCUMENTS

| | | | |
|---|---|---|---|
| JP | 2008-275805 | A | 11/2008 |
| JP | 2010-113199 | A | 5/2010 |

* cited by examiner

*Primary Examiner* — Clayton E LaBalle
*Assistant Examiner* — Kevin Butler
(74) *Attorney, Agent, or Firm* — Banner & Witcoff, Ltd.

(57) ABSTRACT

An image forming apparatus includes: an image forming unit; exposure members; and a cover. The image forming unit includes a cartridge support member for supporting cartridges. The cartridge support member is movable relative to a main casing in a moving direction from an inside position inside the main casing to an outside position outside the main casing. The cover is movable from a first position to a second position such that the cover allows movement of the image forming unit from the inside position to the outside position. The cover includes a first wall and a second wall integral with the first wall. The first wall covers a top side of the image forming unit at the inside position when the cover is at the first position and supports the plurality of exposure members. The second wall covers a downstream side in the moving direction of the image forming unit at the inside position when the cover is at the first position.

24 Claims, 5 Drawing Sheets

IMAGE FORMING APPARATUS CAPABLE OF EASILY DRAWING IMAGE FORMING UNIT FROM MAIN CASING

CROSS REFERENCE TO RELATED APPLICATION

This application claims priority from Japanese Patent Application No. 2012-154317 filed Jul. 10, 2012. The entire content of the priority application is incorporated herein by reference.

TECHNICAL FIELD

The present invention relates to an image forming apparatus in which an exposure member is disposed in proximity to a photosensitive drum.

BACKGROUND

There is conventionally known an image forming apparatus including a main casing, an image forming unit including a plurality of cartridges, and a plurality of exposure members. The image forming unit is slidingly moved relative to the main casing to be pulled out of the main casing. The exposure member includes an array of light emitting portions configured of LEDs (light emitting diodes). The exposure member is disposed in proximity to a photosensitive drum provided in the cartridge. In this type of image forming apparatus, the exposure member is required to be withdrawn from a moving region of the image forming unit when the image forming unit is drawn from the main casing so as not to interfere with the image forming unit.

In this image forming apparatus, the exposure unit is supported to a top cover of the image forming unit, and the top cover is configured to be vertically movable. When the image forming unit is pulled out of the main casing, the top cover is lifted upward, and a front cover of the main casing that is provided on a front side of the image forming unit is also opened.

SUMMARY

However, for drawing the image forming unit from the main casing, a user needs to perform both of the operation for lifting up the top cover and the operation for opening the front cover, which is cumbersome.

In view of the foregoing, it is an object of the present invention to provide an image forming apparatus including an image forming unit provided with a cartridge support member for supporting a plurality of cartridges and capable of easily drawing the image forming unit from a main casing.

In order to attain the above and other objects, the present invention provides an image forming apparatus including: a main casing; an image forming unit; a plurality of photosensitive drums; a plurality of exposure members; and a cover. The image forming unit including: a plurality of cartridges and a cartridge support member. Each of the plurality of cartridges is configured to accommodate a developing agent therein. The cartridge support member is configured to support the plurality of cartridges. The cartridge support member is configured to move relative to the main casing in a moving direction from an inside position in which the cartridge support member is positioned inside the main casing to an outside position in which at least a part of the cartridge support member is outside the main casing. Each of the plurality of photosensitive drums has an axis for defining an axial direction. The plurality of exposure members is provided in one-to-one correspondence with the plurality of photosensitive drums. Each exposure member includes a plurality of light emitting elements for exposing the corresponding photosensitive drum to light. The plurality of light emitting elements is arrayed in the axial direction. The cover is configured to move from a first position to a second position such that the cover allows movement of the image forming unit from the inside position to the outside position. The second position is positioned above the first position. The cover includes a first wall and a second wall integral with the first wall. The first wall is configured to cover a top side of the image forming unit at the inside position when the cover is at the first position and to support the plurality of exposure members. The second wall is configured to cover a downstream side in the moving direction of the image forming unit at the inside position when the cover is at the first position.

According to another aspect, the present invention provides an image forming apparatus including: a main casing; an image forming unit; a plurality of photosensitive drums; an exposure unit; and a cover. The image forming unit includes: a plurality of cartridges and a cartridge support member. Each of the plurality of cartridges is configured to accommodate a developing agent therein. The cartridge support member is configured to support the plurality of cartridges. The cartridge support member is configured to move relative to the main casing in a moving direction from an inside position in which the cartridge support member is positioned inside the main casing to an outside position in which at least a part of the cartridge support member is outside the main casing. The exposure unit is configured to expose the plurality of photosensitive drums. The cover is configured to move from a first position to a second position. The cover includes a first wall and a second wall integral with the first wall. The first wall is configured to cover a top side of the image forming unit at the inside position when the cover is at the first position. The second wall is configured to cover a downstream side in the moving direction of the image forming unit at the inside position when the cover is at the first position.

DETAILED DESCRIPTION

A color printer as an image forming apparatus according to one embodiment of the present invention will be described with reference to FIGS. 1 through 5. Throughout the specification, the terms "upward", "downward", "upper", "lower", "above", "below", "beneath", "right", "left", "front", "rear" and the like will be used assuming that the color printer 1 is disposed in an orientation in which it is intended to be used.

Figure 1:
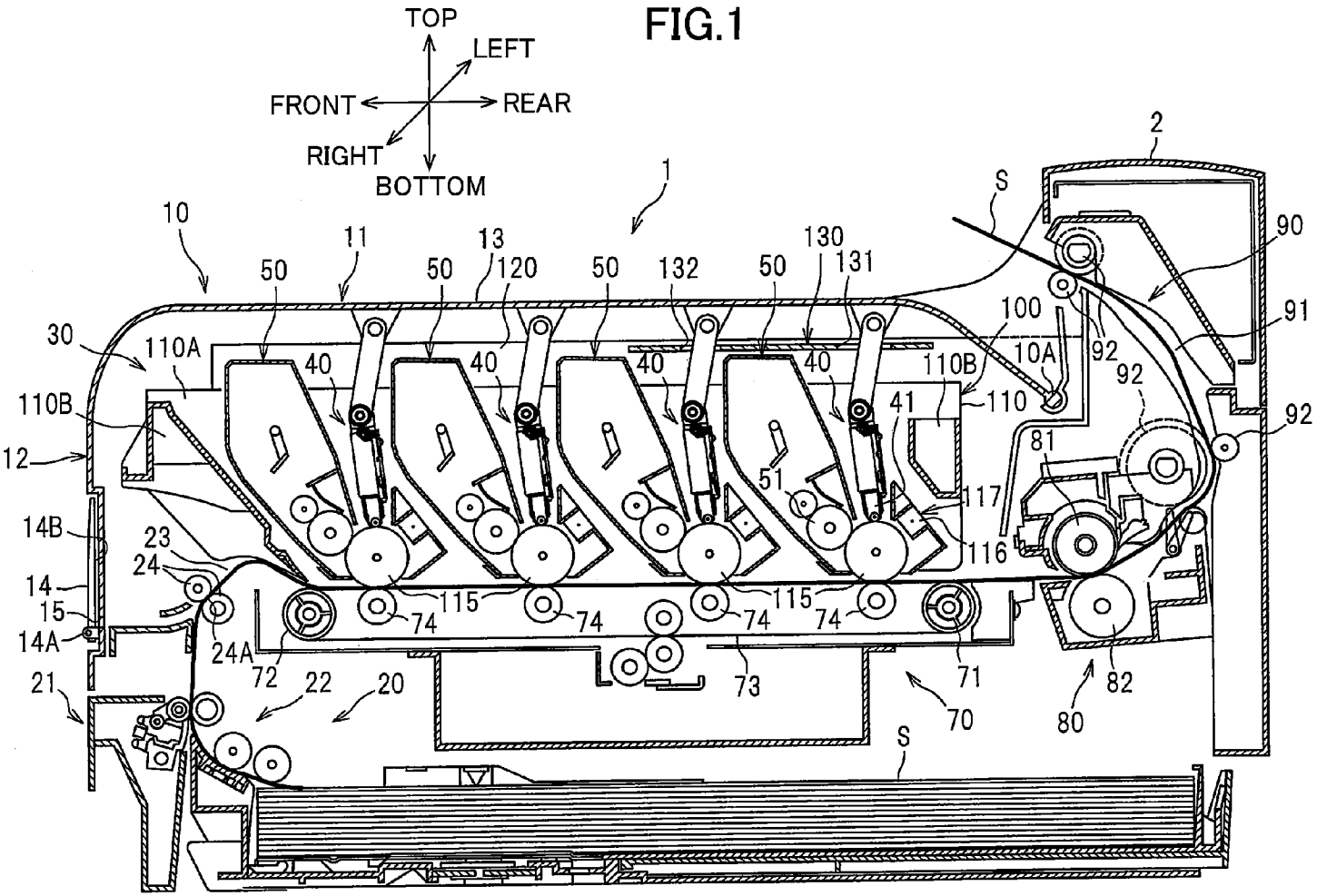
FIG. 1 is a cross-sectional view illustrating an overall structure of a color printer according to one embodiment of the present invention.

More specifically, in FIG. 1 a left side and a right side are a front side and a rear side, respectively. Further, in FIG. 1 a near side and a far side are a right side and a left side, respectively. Further, in FIG. 1 a top side and a bottom side are a top side and a bottom side, respectively.

As shown in FIG. 1, the color printer 1 includes a main casing 2, and within the main casing 2, further includes a sheet supply part 20, an image forming part 30, and a sheet discharge part 90. The sheet supply part 20 is adapted to supply sheets S to the image forming part 30. The image forming part 30 is adapted to form an image on a supplied sheet S. The sheet discharge part 90 is adapted to discharge a sheet S on which an image has been formed. The image forming part 30 includes an image forming unit 100 that can be drawn frontward from the main casing 2.

The main casing 2 has a top portion at which a cover 10 is provided. The cover 10 has a hinge 10A provided at its rear end portion. The cover 10 is pivotally movable relative to the main casing 2 about the hinge 10A such that a front portion of the cover 10 moves vertically. More specifically, the cover 10 is pivotally movable between a first position (see FIG. 1) and a second position (see FIGS. 3 and 4). In the first position, the cover 10 closes an opening defined in the main casing 2. In the second position, the cover 10 permits the image forming unit 100 to be pulled out of the main casing 2 from an inside position (described later) to an outside position (described later). The second position is positioned above the first position.

The cover 10 integrally includes a top cover 11 and a front cover 12. The top cover 11 is adapted to cover a top side of the image forming unit 100 at the inside position when the cover 10 is at the first position. The front cover 12 is adapted to cover a front side of the image forming unit 100 at the inside position when the cover 10 is at the first position. In other words, when the cover 10 is at the first position and the image forming unit 100 is at the inside position, the front cover 12 covers a downstream side of the image forming unit 100 in a pulled-out direction that the image forming unit 100 is pulled out of the main casing 2. More specifically, when the cover 10 is at the first position and the image forming unit 100 is at the inside position, the front cover 12 is disposed so as to overlap with the image forming unit 100 as viewed in the pulled-out position.

The top cover 11 has a top surface serving as a discharge tray 13. The discharge tray 13 is adapted to accumulate thereon the sheets S discharged from the main casing 2. Further, the top cover 11 has a bottom surface to which a plurality of LED units 40 (described later) is fixed.

The sheet supply part 20 includes a sheet supply tray 21 and a sheet supply mechanism 22. The sheet supply tray 21 is disposed at a bottom portion of the main casing 2 and is detachably mounted in the main casing 2. The sheet supply mechanism 22 is adapted to convey the sheets S accommodated in the sheet supply tray 21 toward the image forming part 30.

The sheets S accommodated in the sheet supply tray 21 are separately conveyed upward one by one by the sheet supply mechanism 22. While being conveyed in a sheet conveying path 23, each separated sheet S changes its conveying direction to be directed rearward, and is then supplied to the image forming part 30. In the sheet conveying path 23, a pair of registration rollers 24 is provided. The registration rollers 24 are in pressure contact with each other and nip the sheet S therebetween to convey the sheet S toward the image forming part 30. The sheet conveying path 23 is formed in a generally U-shape, and accordingly, the pair of registration rollers 24 is positioned so as to convey the nipped sheet S upward than the horizontal. After the pair of registration rollers 24 temporarily stops conveying the sheet S to perform skew correction of the sheet S, the sheet S is supplied to the image forming part 30.

The image forming part 30 includes the image forming unit 100, a plurality of LED units 40 (four in the embodiment), a transfer unit 70, and a fixing unit 80.

The image forming unit 100 includes a cartridge support member 110 in which a plurality of photosensitive drums 115 (four in the embodiment) and a plurality of developing cartridges 50 (four in the embodiment) are supported so as to be arrayed in a front-rear direction.

The cartridge support member 110 is movably supported to a left and right pair of rails (not shown) provided at a left and right pair of side frames 120 (see FIG. 2) of the main casing 2, respectively. Each rail extends in the front-rear direction. Hence, the cartridge support member 110 is movable relative to the main casing 2 in a direction that the plurality of photosensitive drums 115 is arrayed, that is, in the front-rear direction. More specifically, the cartridge support member 110 is movable between the inside position (see FIGS. 1 and 3) where the cartridge support member 110 is inside the main casing 2 and the outside position (see FIG. 4) where at least a part of the cartridge support member 110 is outside the main casing 2. Note that the outside position implies a position where all of the developing cartridges 50 are detachable from or attachable to the cartridge support member 110.

The cartridge support member 110 is formed in a frame-like shape having a left and right pair of side frames 110A and front and rear cross beams 110B, 110B. The respective side frames 110A are disposed on respective sides of the photosensitive drums 115 in an axial direction thereof. That is, the left and right side frames 110A are disposed on left and right sides of the photosensitive drums 115, respectively. The front cross beam 110B connects front edges of the side frames 110A, and the rear cross beam 110B connects rear edges of the side frames 110A. A plurality of photosensitive units 117 (four in the embodiment) is supported to the cartridge support member 110 so as to be disposed between the pair of side frames 110A. Each photosensitive unit 117 includes the photosensitive drum 115 and a charger 116.

Figure 2:
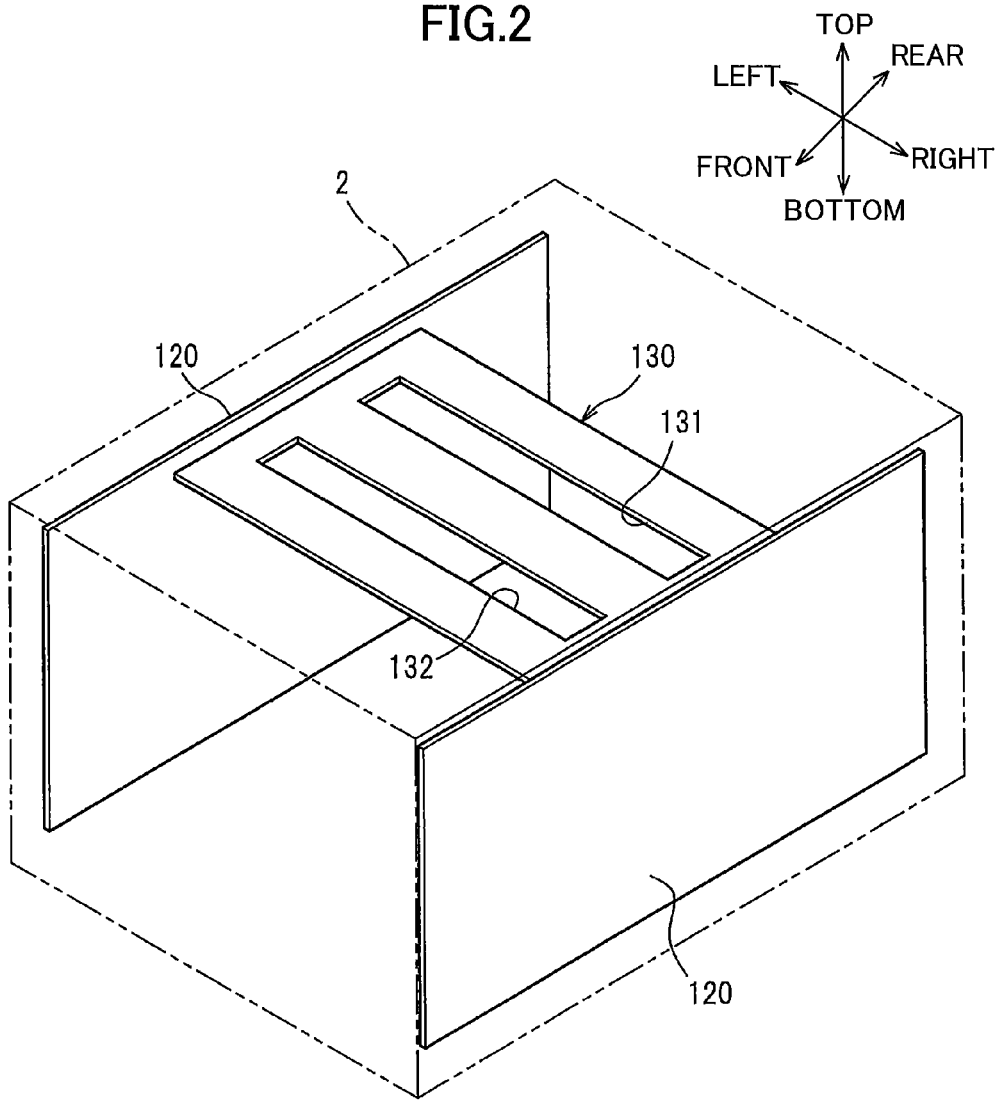
FIG. 2 is perspective view of a pair of side frames and a reinforcement member provided in a main casing of the color printer.

The pair of side frames 120 of the main casing 2 is formed of metal. The respective side frames 120 are disposed on respective sides (left and right sides) of the image forming unit 100 in the axial direction of the photosensitive drum 115. As shown in FIG. 2, upper portions of the left and right side frames 120 are connected via a metal reinforcement plate 130. The reinforcement plate 130 is disposed above the cartridge support member 110 at the inside position, as shown in FIG. 1. The reinforcement plate 130 is formed with openings 131, 132 at positions corresponding to two of the LED units 40. The openings 131, 132 allowing the LED units 40 to pass therethrough prevent the LED units 40 from interfering with the reinforcement plate 130 when the cover 10 is opened and closed. In the present embodiment, the reinforcement plate 130 is disposed above the two developing cartridges 50 on a rear side. Hence, the openings 131, 132 are formed at positions corresponding to these two developing cartridges 50.

Each developing cartridge 50 is adapted to accommodate toner therein and includes a developing roller 51 corresponding to the photosensitive drum 115. Each developing cartridge 50 is detachable from and attachable to the cartridge support member 110 through a top opening formed in the cartridge support member 110.

The plurality of LED units 40 is provided in one-to-one correspondence with the plurality of photosensitive drums 115. Each LED unit 40 includes an LED array member 41 for exposing the corresponding photosensitive drums 115 to light. While not shown in the drawings, the LED array member 41 has a bottom surface on which a plurality of LEDs serving as light emitting elements is arrayed in the axial direction of the photosensitive drum 115. The LED array member 41 is positioned in proximity to and substantially immediately above the corresponding photosensitive drum 115. Further, the LED array member 41 is positioned in proximity to and rearward of the corresponding developing cartridge 50.

The transfer unit 70 is disposed between the sheet supply part 20 and the image forming unit 100. The transfer unit 70 includes a drive roller 71, a driven roller 72, a conveying belt 73, and a plurality of transfer rollers 74 (four in the embodiment).

The drive roller 71 and the driven roller 72 are juxtaposed with each other and spaced apart from each other in the front-rear direction. The conveying belt 73 is formed of an endless belt and stretched around the drive roller 71 and the driven roller 72. The conveying belt 73 has an outer surface in contact with the plurality of photosensitive drums 115. Each of the transfer rollers 74 is disposed within the conveying belt 73 and in confrontation with the corresponding photosensitive drum 115, with an upper portion of the conveying belt 73 interposed between the transfer roller 74 and the photosensitive drum 115. Transfer bias is applied to the transfer rollers 74 by means of constant current control when transferring a toner image onto a sheet S.

The fixing unit 80 is disposed rearward of the image forming unit 100 and the transfer unit 70. The fixing unit 80 includes a heating roller 81 and a pressure roller 82 that opposes the heating roller 81 and applies pressure thereto.

In the image forming part 30 configured as described above, each charger 116 applies a uniform charge to a surface of the corresponding photosensitive drum 115. Subsequently, the photosensitive drum 115 is exposed to LED light emitted from the corresponding LED unit 40. As a result, an electric potential of the exposed area lowers, and an electrostatic latent image based on image data is formed on the photosensitive drum 115.

Toner accommodated in each developing cartridge 50 is supplied to and carried on a surface of the developing roller 51 at a thin uniform thickness. The toner carried on the surface of the developing roller 51 is supplied to the electrostatic latent image formed on the corresponding photosensitive drum 115 as the developing roller 51 confronts and contacts the photosensitive drum 115. As a result, the toner is selectively carried on the photosensitive drum 115 to develop the electrostatic latent image on the photosensitive drum 115 into a visible toner image through reverse development.

Subsequently, as the sheet S onto the conveying belt 73 passes through positions between the photosensitive drums 115 and the transfer rollers 74, the toner images formed on the respective photosensitive drums 115 are transferred onto the sheet S. While the sheet S passes between the heating roller 81 and the pressure roller 82, the toner images transferred onto the sheet S are thermally fixed onto the sheet S.

The sheet discharge part 90 includes a discharge-side sheet conveying path 91 and a plurality of pairs of conveying rollers 92. The discharge-side sheet conveying path 91 extends upward from an exit of the fixing unit 80 and then curves frontward. Each pair of conveying rollers 92 is adapted to convey the sheet S. The sheet S onto which the toner images have been fixed is conveyed in the discharge-side sheet conveying path 91 by the conveying rollers 92, and discharged from the main casing 2 to be accumulated on the discharge tray 13.

Next, a detailed structure of the cover 10 will be described.

The front cover 12 has a bottom portion to which a manual feed tray 14 is supported. The manual feed tray 14 is adapted to mount a sheet S used for manual-feed printing thereon to supply the sheet S to the registration rollers 24. The manual feed tray 14 has a pivot shaft 14A at its bottom end portion. The pivot shaft 14A is supported to a shaft bearing portion (shown in FIGS. 1 and 5 but without reference sign) of the front cover 12. With this configuration, the manual feed tray 14 is pivotally movable between a storage position (see FIG. 1) in which the manual feed tray 14 is upright along the front cover 12 and an access position (see FIG. 5) in which the manual feed tray 14 extends in a generally horizontal direction.

The front cover 12 is formed with a manual feed slot 15. The manual feed slot 15 is disposed in flush with a sheet mount surface 14B of the manual feed tray 14 at the access position shown in FIG. 5. The manual feed slot 15 and an axis of the pivot shaft 14A of the manual feed tray 14 is positioned below a nip position 24A where the sheet S is nipped between the pair of registration rollers 24. A guide member 16 is provided at a position between the manual feed slot 15 and the pair of registration rollers 24. The guide member 16 is adapted to guide the sheet S fed through the manual feed slot 15 toward the pair of registration rollers 24. A pair of conveying rollers for conveying the sheet S from the manual feed slot 15 to the registration rollers 24 or a sensor for detecting the sheet S inserted into the manual feed slot 15 may also be provided at the position between the manual feed slot 15 and the pair of registration rollers 24, if desired.

Figure 3:
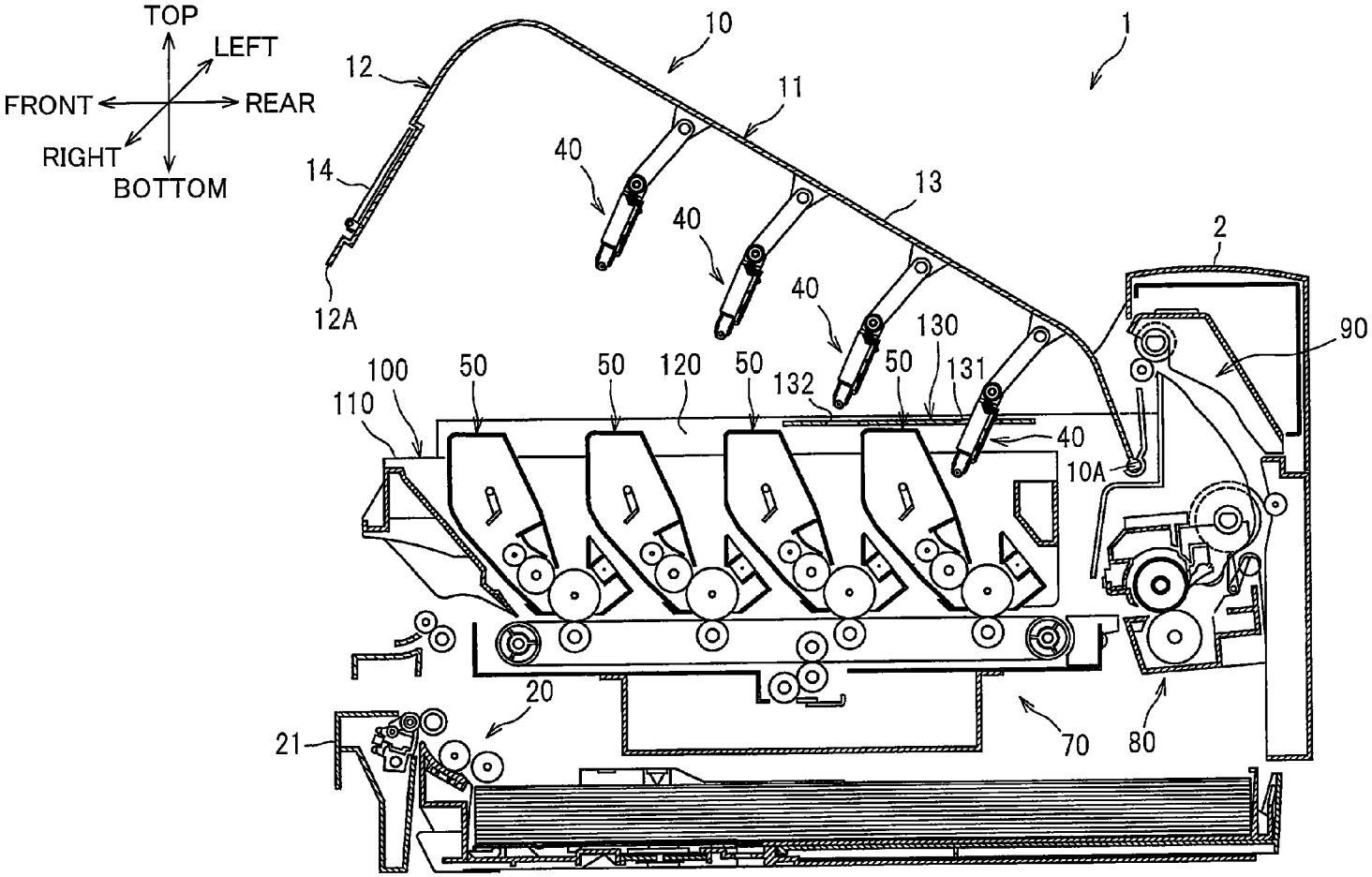
FIG. 3 is a cross-sectional view of the color printer showing a state where a cover is opened at a second position.

As shown in FIG. 3, the cover 10 is configured such that the image forming unit 100 can be easily detached from and attached to the main casing 2 when the cover 10 is at the second position where the cover 10 is open upward. When the cover 10 is at the second position, a bottom edge 12A of the front cover 12 is positioned above the image forming unit 100. Hence, the front cover 12 is positioned so as not to overlap with the image forming unit 100 as viewed from a front side, that is, as viewed in the pulled-out direction. Further, at this time, except for the rearmost LED unit 40 that is positioned on a most upstream side in the pulled-out direction among the four LED units 40, the remaining three LED units 40 are positioned so as not to overlap with the image forming unit 100 as viewed in the pulled-out direction.

Figure 4:
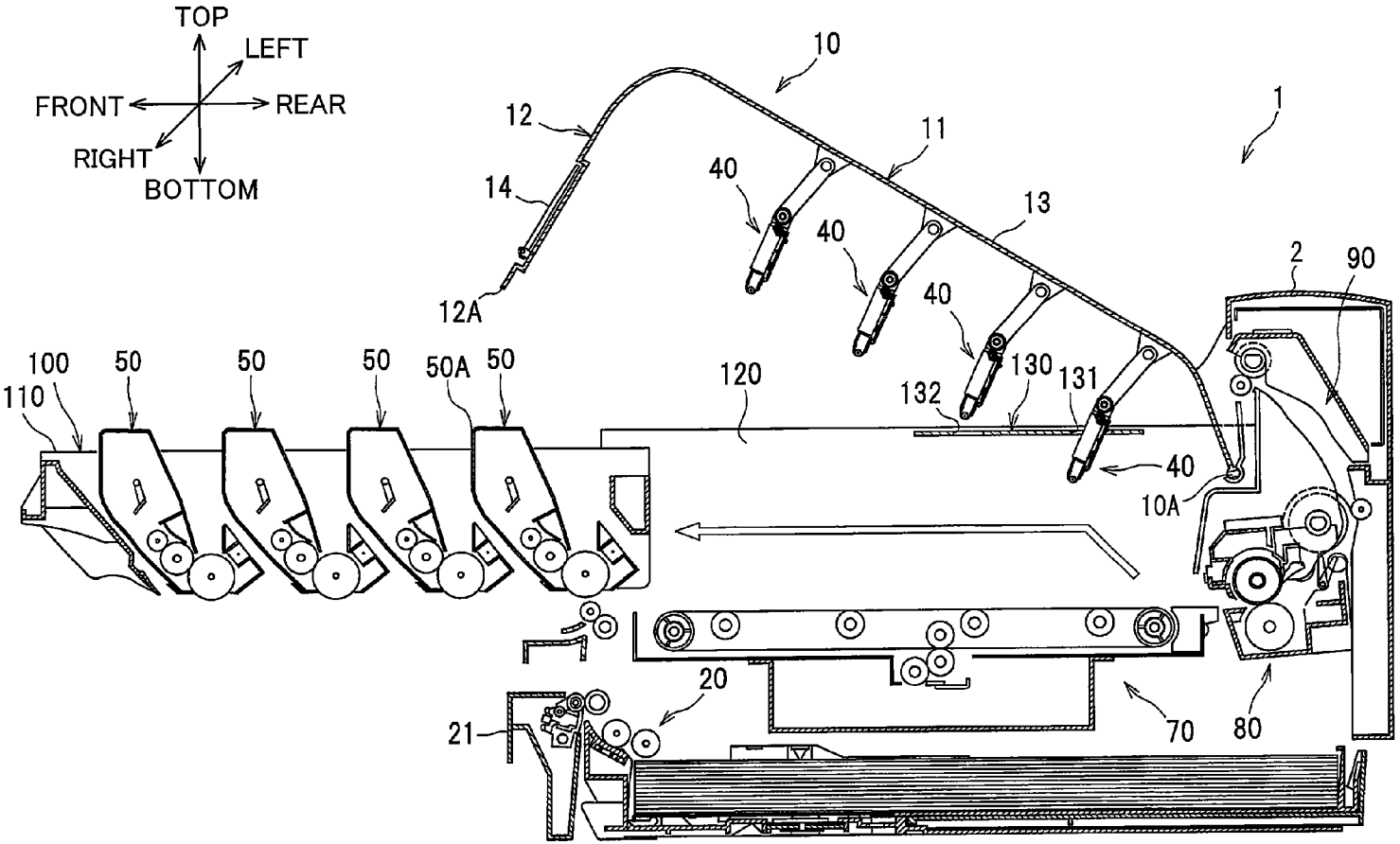
FIG. 4 is a cross-sectional view of the color printer showing a state where an image forming unit has been drawn from the man casing.

As shown in FIG. 4, when the cover 10 is at the second position and the cartridge support member 110 is at the outside position, the bottom edge 12A of the front cover 12 is positioned upstream of a downstream edge 50A of the rearmost developing cartridge 50 that is positioned on a most upstream side in the pulled-out direction among the four developing cartridges 50.

Next, operations for detachment and attachment of the image forming unit 100 relative to the main casing 2 of the color printer 1 configured as described above will be described. An operation for manual-feed printing in the color printer 1 configured as described above will be also described.

When the color printer 1 is in use, the image forming unit 100 is positioned at the inside position, and the cover 10 is closed and at the first position, as shown in FIG. 1. The main casing 2 of the color printer 1 has high stiffness since the side frames 120 are connected to the reinforcement plate 130 to be reinforced. Accordingly, color deviation during color printing operations can be prevented.

When the image forming unit 100 is removed from the main casing 2 and maintenance operations, such as replacement of the developing cartridge 50, are performed, as shown in FIG. 3, the cover 10 is fully open upward to be positioned at the second position. Subsequently, as shown in FIG. 4, the image forming unit 100 is pulled out of the main casing 2 frontward to be positioned at the outside position. When the cover 10 is at the second position, the bottom edge 12A of the front cover 12 is positioned above the image forming unit 100. Accordingly, when the image forming unit 100 is drawn from the main casing 2, the image forming unit 100 does not interfere with the bottom edge 12A of the front cover 12. Therefore, the image forming unit 100 can be smoothly drawn from the main casing 2. Hence, damages to the front cover 12 and the image forming unit 100 can be avoided.

Further, each of the LED units 40 is disposed rearward of the corresponding developing cartridge 50. When the cover 10 is moved to the second position, three of the four LED units 40 excluding the rearmost LED unit 40 positioned on the most upstream side in the pulled-out direction do not overlap with the image forming unit 100 as viewed in the pulled-out position. Accordingly, when the image forming unit 100 is pulled out of the main casing 2, interference of the image forming unit 100 with the LED units 40 can be prevented. Hence, damages to the LED units 40 and the image forming unit 100 can be avoided.

Further, when the cover 10 is open to be positioned at the second position, the rear two LED units 40 pass through the openings 131, 132 formed in the reinforcement plate 130, respectively. Accordingly, the presence of the reinforcement plate 130 does not hinder opening and closing movement of the cover 10.

Further, when the image forming unit 100 is at the outside position as shown in FIG. 4, at least a part (downstream edge 50A) of the rearmost developing cartridge 50 is positioned frontward of the bottom edge 12A of the front cover 12. Accordingly, the rearmost developing cartridge 50 can be easily accessed.

After maintenance operations have been completed in a state shown in FIG. 4, for example, a desired developing cartridge 50 has been replaced with a new one, the steps in the operation for detaching the image forming unit 100 described above are performed in reverse. That is, the image forming unit 100 is pushed rearward to be positioned at the inside position shown in FIG. 3. Then, the cover 10 is closed to be positioned at the first position shown in FIG. 1. As a result, the color printer 1 is ready for an image forming operation.

In the color printer 1 according to the present embodiment, the cover 10 integrally includes the top cover 11 that supports the LED units 40 and the front cover 12 that covers the downstream side in the pulled-out direction of the image forming unit 100. Accordingly, when the cover 10 is moved from the first position to the second position, the top cover 11 and the front cover 12 are moved together, thereby permitting the image forming unit 100 to be moved from the inside position to the outside position. Therefore, a single operation for opening only the cover 10 that supports the LED units 40 allows the image forming unit 100 to be pulled out of the main casing 2.

Figure 5:
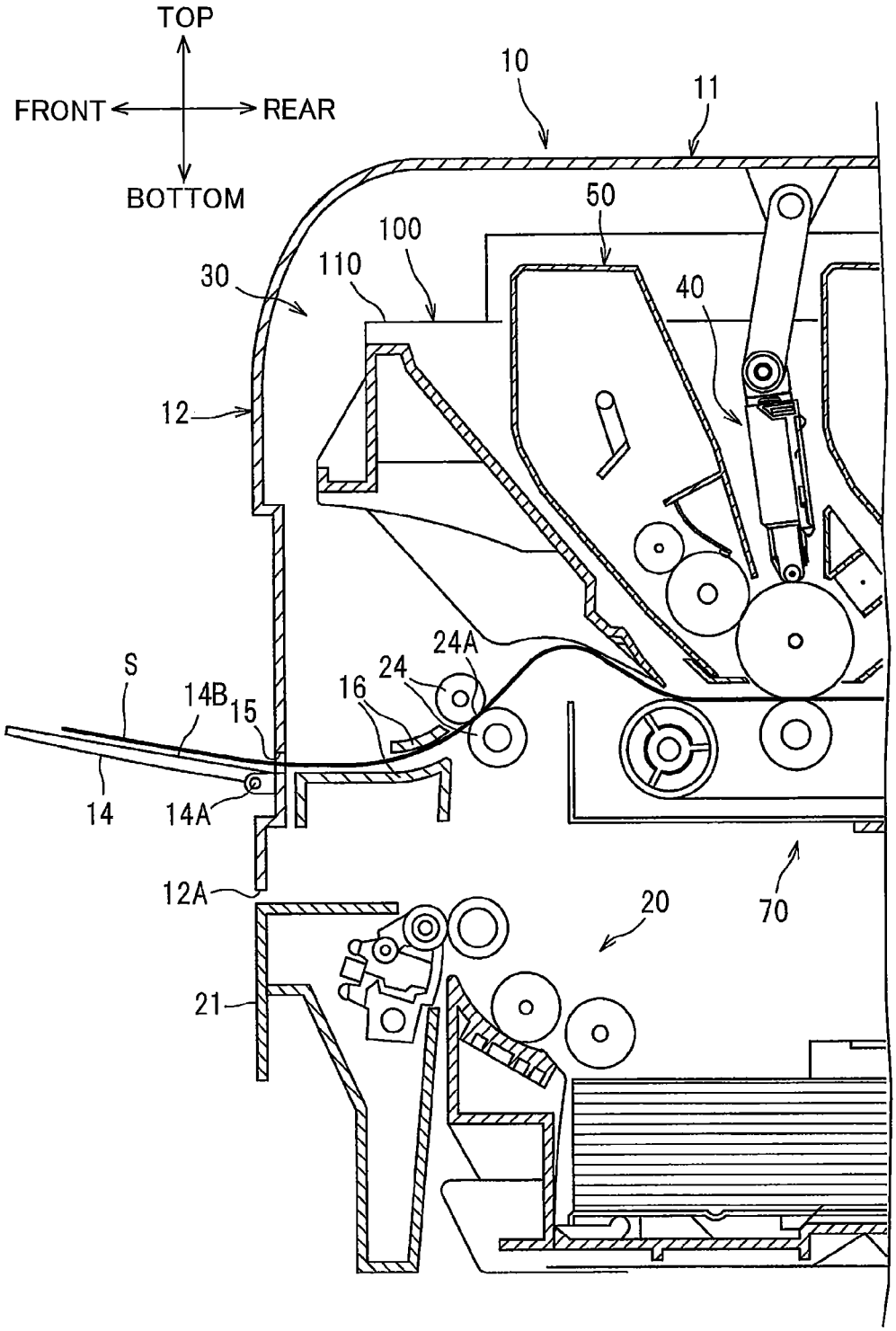
FIG. 5 is an enlarged partial cross-sectional view of the color printer showing a state where a sheet is supplied to an image forming part from a manual feed tray.

When the manual-feed printing is performed, the manual feed tray 14 is inclined frontward to be positioned at the access position, and the sheet S is mounted on the manual feed tray 14, as shown in FIG. 5. When the sheet S is inserted into the manual feed slot 15, the sheet S is guided by the guide member 16, and a leading edge of the sheet S reaches the nip position 24A of the registration rollers 24. When the sensor (not shown) for detecting the sheet S detects that the sheet S has been inserted into the manual feed slot 15, the pair of registration rollers 24 conveys the sheet S upward in an appropriately-timed manner to supply the sheet S to the image forming part 30. Then, the steps in the image forming operation described above are performed for forming an image on the sheet S.

In the manual-feed printing, the color printer 1 according to the present embodiment has a configuration for supplying the sheet S for manual-feed printing to the pair of registration rollers 24 which is configured to convey the sheet S upward than the horizontal. Since the manual feed slot 15 and the axis of the pivot shaft 14A of the manual feed tray 14 are positioned downward of the nip position 24A of the registration rollers 24, the sheet S can be smoothly supplied from the manual feed tray 14 to the nip position 24A.

Various modifications are conceivable.

The developing cartridge is exemplified as a claimed cartridge in the above-described embodiment. However, for example, the cartridge may be a developer cartridge without the developing roller. Alternatively, the cartridge may be a process cartridge including the developing roller and the photosensitive drum.

The cartridge support member is removed from and inserted into the main casing in the horizontal direction in the above-described embodiment. However, a configuration may be possible in which the cartridge support member is removed from and inserted into the main casing in a direction angled with respect to the horizontal direction. Further, at the outside position, only a part of the cartridge support member may be outside the main casing, or alternatively, the cartridge support member in its entirety may be outside the main casing and removable from the main casing.

The manual feed slot is formed in the front cover in the above-described embodiment. However, the manual feed slot may be formed on a front wall of the main casing 2 below the front cover. Alternatively, a gap between the front wall and the front cover may serve as the manual feed slot. The manual feed slot may be dispensed with.

The exposure member includes the LEDs as light emitting elements in the above-described embodiment. However, the exposure member may include light emitting elements other than the LEDs.

The present invention is applied to the color printer in the above-described embodiment. However, the present invention may be applied to another type of an image forming apparatus, such as a copier, or a multifunction machine.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

a main casing;

an image forming unit comprising:

a plurality of cartridges, each configured to accommodate developing agent therein; and a cartridge support member configured to support the plurality of cartridges, the cartridge support member being configured to move relative to the main casing in a moving direction from an inside position in which the cartridge support member is positioned inside the main casing to an outside position in which at least a part of the cartridge support member is outside the main casing;

a plurality of photosensitive drums, each photosensitive drum having an axis for defining an axial direction;

a plurality of exposure members provided in one-to-one correspondence with the plurality of photosensitive drums, each exposure member including a plurality of light emitting elements for exposing a corresponding one of the plurality of photosensitive drums to light, the plurality of light emitting elements being arrayed in the axial direction; and a cover configured to move from a first position to a second position such that the cover allows movement of the image forming unit from the inside position to the outside position, the second position being positioned above the first position, the cover including a first wall and a second wall integral with the first wall, the first wall being configured to cover a top side of the image forming unit at the inside position when the cover is at the first position and to support the plurality of exposure members, the second wall being configured to cover a downstream side in the moving direction of the image forming unit at the inside position when the cover is at the first position, wherein the second wall is formed with a manual feed slot for feeding a recording sheet for manual-feed printing.

2. The image forming apparatus as claimed in claim 1, wherein the image forming unit is disposed not to overlap with the second wall as viewed in the moving direction when the cover is at the second position, and to overlap with the second wall as viewed in the moving direction when the cover is at the first position.

3. The image forming apparatus as claimed in claim 1, wherein the cover has an upstream end portion in the moving direction and is configured to pivotally move between the first position and the second position about the upstream end portion, and wherein the plurality of exposure members is juxtaposed with each other in the moving direction and includes a first exposure member positioned on a most upstream side in the moving direction, the plurality of exposure members other than the first exposure member being disposed not to overlap with the image forming unit as viewed in the moving direction when the cover is at the second position.

4. The image forming apparatus as claimed in claim 1, further comprising a pair of conveying rollers configured to convey a recording sheet upward toward the image forming unit, the pair of conveying rollers defining a nip position where the recording sheet is nipped between the pair of conveying rollers, wherein the manual feed slot is configured to allow the recording sheet to be conveyed toward the pair of conveying rollers therethrough, and wherein the manual feed slot is positioned below the nip position when the cover is at the first position.

5. The image forming apparatus as claimed in claim 1, further comprising:

a pair of conveying rollers configured to convey a recording sheet upward toward the image forming unit, the pair of conveying rollers defining a nip position where the recording sheet is nipped between the pair of conveying rollers; and a manual feed tray provided at the second wall and configured to mount a recording sheet thereon to feed the recording sheet toward the pair of conveying rollers, the manual feed tray having a bottom end at which a pivot axis is provided and being pivotally movable relative to the second wall about the pivot axis, the pivot axis being positioned below the nip position when the cover is at the first position.

6. The image forming apparatus as claimed in claim 1, wherein the second wall has a bottom edge, wherein the plurality of cartridges is juxtaposed with each other in the moving direction and includes a first cartridge positioned on a most upstream side in the moving direction, the first cartridge having a downstream edge in the moving direction, and wherein when the cover is at the second position and the cartridge support member is at the outside position, the bottom edge of the second wall of the cover is positioned upstream of the downstream edge of the first cartridge in the moving direction.

7. The image forming apparatus as claimed in claim 1, wherein the main casing includes a pair of side frames and a reinforcement member, the image forming unit being disposed between the pair of side frames in the axial direction and the reinforcement member connecting the pair of side frames and being disposed above the cartridge support member at the inside position.

8. The image forming apparatus as claimed in claim 7, wherein the reinforcement member has an opening allowing the exposure member to pass therethrough when the cover moves from the first position to the second position.

9. An image forming apparatus comprising:

a main casing;

an image forming unit comprising:

a plurality of cartridges, each configured to accommodate developing agent therein; and a cartridge support member configured to support the plurality of cartridges, the cartridge support member being configured to move relative to the main casing in a moving direction from an inside position in which the cartridge support member is positioned inside the main casing to an outside position in which at least a part of the cartridge support member is outside the main casing;

a plurality of photosensitive drums, each photosensitive drum having an axis for defining an axial direction;

a plurality of exposure members provided in one-to-one correspondence with the plurality of photosensitive drums, each exposure member including a plurality of light emitting elements for exposing a corresponding one of the plurality of photosensitive drums to light, the plurality of light emitting elements being arrayed in the axial direction;

a cover configured to move from a first position to a second position such that the cover allows movement of the image forming unit from the inside position to the outside position, the second position being positioned above the first position, the cover including a first wall and a second wall integral with the first wall, the first wall being configured to cover a top side of the image forming unit at the inside position when the cover is at the first position and to support the plurality of exposure members, the second wall being configured to cover a downstream side in the moving direction of the image forming unit at the inside position when the cover is at the first position;

a pair of conveying rollers configured to convey a recording sheet upward toward the image forming unit, the pair of conveying rollers defining a nip position where the recording sheet is nipped between the pair of conveying rollers; and a manual feed tray provided at the second wall and configured to mount a recording sheet thereon to feed the recording sheet toward the pair of conveying rollers, the manual feed tray having a bottom end at which a pivot axis is provided and being pivotally movable relative to the second wall about the pivot axis, the pivot axis being positioned below the nip position when the cover is at the first position.

10. The image forming apparatus as claimed in claim 9, wherein the image forming unit is disposed not to overlap with the second wall as viewed in the moving direction when the cover is at the second position, and to overlap with the second wall as viewed in the moving direction when the cover is at the first position.

11. The image forming apparatus as claimed in claim 9, wherein the cover has an upstream end portion in the moving direction and is configured to pivotally move between the first position and the second position about the upstream end portion, and wherein the plurality of exposure members is juxtaposed with each other in the moving direction and includes a first exposure member positioned on a most upstream side in the moving direction, the plurality of exposure members other than the first exposure member being disposed not to overlap with the image forming unit as viewed in the moving direction when the cover is at the second position.

12. The image forming apparatus as claimed in claim 9, wherein the second wall is formed with a manual feed slot for feeding a recording sheet for manual-feed printing.

13. The image forming apparatus as claimed in claim 12, further comprising a pair of conveying rollers configured to convey a recording sheet upward toward the image forming unit, the pair of conveying rollers defining a nip position where the recording sheet is nipped between the pair of conveying rollers, wherein the manual feed slot is configured to allow the recording sheet to be conveyed toward the pair of conveying rollers therethrough, and wherein the manual feed slot is positioned below the nip position when the cover is at the first position.

14. The image forming apparatus as claimed in claim 9, wherein the second wall has a bottom edge, wherein the plurality of cartridges is juxtaposed with each other in the moving direction and includes a first cartridge positioned on a most upstream side in the moving direction, the first cartridge having a downstream edge in the moving direction, and wherein when the cover is at the second position and the cartridge support member is at the outside position, the bottom edge of the second wall of the cover is positioned upstream of the downstream edge of the first cartridge in the moving direction.

15. The image forming apparatus as claimed in claim 9, wherein the main casing includes a pair of side frames and a reinforcement member, the image forming unit being disposed between the pair of side frames in the axial direction and the reinforcement member connecting the pair of side frames and being disposed above the cartridge support member at the inside position.

16. The image forming apparatus as claimed in claim 15, wherein the reinforcement member has an opening allowing the exposure member to pass therethrough when the cover moves from the first position to the second position.

17. An image forming apparatus comprising:

a main casing;

an image forming unit comprising:

a plurality of cartridges, each configured to accommodate developing agent therein; and a cartridge support member configured to support the plurality of cartridges, the cartridge support member being configured to move relative to the main casing in a moving direction from an inside position in which the cartridge support member is positioned inside the main casing to an outside position in which at least a part of the cartridge support member is outside the main casing;

a plurality of photosensitive drums, each photosensitive drum having an axis for defining an axial direction;

a plurality of exposure members provided in one-to-one correspondence with the plurality of photosensitive drums, each exposure member including a plurality of light emitting elements for exposing a corresponding one of the plurality of photosensitive drums to light, the plurality of light emitting elements being arrayed in the axial direction; and a cover configured to move from a first position to a second position such that the cover allows movement of the image forming unit from the inside position to the outside position, the second position being positioned above the first position, the cover including a first wall and a second wall integral with the first wall, the first wall being configured to cover a top side of the image forming unit at the inside position when the cover is at the first position and to support the plurality of exposure members, the second wall being configured to cover a downstream side in the moving direction of the image forming unit at the inside position when the cover is at the first position, wherein the main casing includes a pair of side frames and a reinforcement member, the image forming unit being disposed between the pair of side frames in the axial direction and the reinforcement member connecting the pair of side frames and being disposed above the cartridge support member at the inside position.

18. The image forming apparatus as claimed in claim 17, wherein the image forming unit is disposed not to overlap with the second wall as viewed in the moving direction when the cover is at the second position, and to overlap with the second wall as viewed in the moving direction when the cover is at the first position.

19. The image forming apparatus as claimed in claim 17, wherein the cover has an upstream end portion in the moving direction and is configured to pivotally move between the first position and the second position about the upstream end portion, and wherein the plurality of exposure members is juxtaposed with each other in the moving direction and includes a first exposure member positioned on a most upstream side in the moving direction, the plurality of exposure members other than the first exposure member being disposed not to overlap with the image forming unit as viewed in the moving direction when the cover is at the second position.

20. The image forming apparatus as claimed in claim 17, wherein the second wall is formed with a manual feed slot for feeding a recording sheet for manual-feed printing.

21. The image forming apparatus as claimed in claim 20, further comprising a pair of conveying rollers configured to convey a recording sheet upward toward the image forming unit, the pair of conveying rollers defining a nip position where the recording sheet is nipped between the pair of conveying rollers, wherein the manual feed slot is configured to allow the recording sheet to be conveyed toward the pair of conveying rollers therethrough, and wherein the manual feed slot is positioned below the nip position when the cover is at the first position.

22. The image forming apparatus as claimed in claim 17, further comprising:

a pair of conveying rollers configured to convey a recording sheet upward toward the image forming unit, the pair of conveying rollers defining a nip position where the recording sheet is nipped between the pair of conveying rollers; and a manual feed tray provided at the second wall and configured to mount a recording sheet thereon to feed the recording sheet toward the pair of conveying rollers, the manual feed tray having a bottom end at which a pivot axis is provided and being pivotally movable relative to the second wall about the pivot axis, the pivot axis being positioned below the nip position when the cover is at the first position.

23. The image forming apparatus as claimed in claim 17, wherein the second wall has a bottom edge, wherein the plurality of cartridges is juxtaposed with each other in the moving direction and includes a first cartridge positioned on a most upstream side in the moving direction, the first cartridge having a downstream edge in the moving direction, and wherein when the cover is at the second position and the cartridge support member is at the outside position, the bottom edge of the second wall of the cover is positioned upstream of the downstream edge of the first cartridge in the moving direction.

24. The image forming apparatus as claimed in claim 17, wherein the reinforcement member has an opening allowing the exposure member to pass therethrough when the cover moves from the first position to the second position.

* * * * *